US008502464B2

(12) United States Patent
Lakirovich et al.

(10) Patent No.: US 8,502,464 B2
(45) Date of Patent: Aug. 6, 2013

(54) UNDERWATER LIGHTING SYSTEM AND METHOD

(75) Inventors: Konstantin Lakirovich, Chicago, IL (US); Thomas Puvogel, Naperville, IL (US)

(73) Assignee: Control Solutions LLC, Aurora, IL (US)

( * ) Notice: Subject to any disclaimer, the term of this patent is extended or adjusted under 35 U.S.C. 154(b) by 217 days.

(21) Appl. No.: 13/030,803

(22) Filed: Feb. 18, 2011

(65) Prior Publication Data

US 2012/0212150 A1 Aug. 23, 2012

(51) Int. Cl.
*H05B 41/16* (2006.01)

(52) U.S. Cl.
USPC ..... 315/276; 315/254; 315/312

(58) Field of Classification Search
USPC ..... 315/86, 87, 88, 89, 90, 93, 127, 128, 315/177, 185 R, 186, 192, 193, 200 R, 201, 315/205, 210, 212, 217, 225, 226, 246, 250, 315/254, 276, 294, 295, 297, 299, 306, 307, 315/308, 312, 313, 320, 361, 360, 362
See application file for complete search history.

(56) References Cited

U.S. PATENT DOCUMENTS 5,144,280 A * 9/1992 Foord ..... 375/344
5,264,997 A 11/1993 Hutchisson et al.
5,301,096 A 4/1994 Klontz et al.
5,341,280 A 8/1994 Divan et al.
6,188,179 B1 2/2001 Boys et al.
6,459,218 B2 10/2002 Boys et al.
6,662,742 B2 12/2003 Shelton et al.
6,798,309 B2 9/2004 Lohr et al.
6,808,021 B2 10/2004 Zimmerman et al.
6,813,316 B2 11/2004 Lohr
6,825,620 B2 11/2004 Kuennen et al.
6,956,450 B1 10/2005 Lohr
7,088,222 B1 8/2006 Dueker et al.
7,178,178 B2 2/2007 Hutchings
7,180,248 B2 2/2007 Keunnen et al.
7,207,701 B2 4/2007 Kennedy et al.
7,277,675 B2 10/2007 Lohr et al.
7,385,357 B2 6/2008 Kuennen et al.
7,410,269 B2 8/2008 Harrity et al.
2005/0023988 A1 * 2/2005 Komatsu et al. ..... 315/224

(Continued)

*Primary Examiner* — Douglas W Owens
*Assistant Examiner* — Jianzi Chen
(74) *Attorney, Agent, or Firm* — McCracken & Frank LLC

(57) ABSTRACT

A lighting system for wirelessly providing power to a lighting assembly across a wall. The lighting system may be used, for example, for powering the lighting assembly positioned on an outside portion of the wall, such as on the outside of a boat hull. An example of the lighting system includes a power transmitter with a multi-frequency generator connected to a power source and a controller. The multi-frequency generator is configured to generate an oscillating signal at a predetermined frequency according to a control signal received from the controller. The power transmitter includes a transmitting coil connected to receive the oscillating signal. A receiving coil is positioned to form an inductive coupling with the transmitting coil. A plurality of conditioning units are connected to the receiving coil to receive the oscillating signal. The plurality of conditioning units are connected to provide power to a corresponding light or set of lights. The conditioning units provide power to the corresponding lights when the selected one of the plurality of frequencies matches a resonant frequency of one of a plurality of resonant circuits formed by the receiving coil, transmitting coil, and a resonant capacitor in each of the plurality of conditioning units.

38 Claims, 8 Drawing Sheets

(56) References Cited

U.S. PATENT DOCUMENTS

2006/0002110 A1 1/2006 Dowling et al.
2007/0109708 A1 5/2007 Hussman et al.
2008/0112158 A1 5/2008 Ellis
2008/0130268 A1 6/2008 Johnson et al.
2009/0009093 A1 1/2009 Vernondier et al.

* cited by examiner

UNDERWATER LIGHTING SYSTEM AND METHOD

FIELD OF THE INVENTION

The invention relates to wireless power transmission, and more particularly to wireless power transmission through a solid barrier to one or more light sources.

BACKGROUND

Lights are often needed underwater. Boats and other structures that are at least partially submerged under water are often required to either signal their presence, using lights or to illuminate the surrounding area. In some cases, lights of different colors may be needed as part of the signaling. Lights of the same color may be used for illumination or signaling by varying color temperature.

Providing lighting underwater presents several problems. The most obvious is the need to provide electrical power to the lights in a medium that is a conductor of electricity. For example, lights may be required on the portion of the hull of a boat that is submerged underwater. While it may be possible to seal the lights in a waterproof chamber, providing power to the lights would require breaching the hull and wiring electrical power through holes to the lights from a power source inside the boat. It is also possible, though rather impractical, to provide a separate power source on the outside of the hull.

Where multi-colored lights are to be used, a further problem exists in communicating what color to use. In some examples, separate communication lines are used to select a different color light, or multiple lights of different colors are separately powered to light as provided from inside the structure. Color selection typically requires added wiring through the breach in the structure.

There is a need for a lighting system having lights on the submerged portion of a structure in water that are powered by electrical power inside the boat without requiring the breaching of the wall between the inside and outside of the structure.

SUMMARY

In view of the above, a lighting system is provided for wirelessly powering a lighting assembly. An example of the lighting system includes a multi-frequency generator connected to a power source and a controller. The multi-frequency generator is configured to generate an oscillating signal at a predetermined frequency according to a control signal received from the controller. A power transmitter includes a transmitting coil connected to receive the oscillating signal. A receiving coil is positioned to form an inductive coupling with the transmitting coil. A plurality of conditioning units are connected to the receiving coil to receive the oscillating signal. The plurality of conditioning units are connected to provide power to a corresponding light or set of lights. The conditioning units provide power to the corresponding lights when the selected one of the plurality of frequencies matches a resonant frequency of one of a plurality of resonant circuits formed by the receiving coil, transmitting coil, and a resonant capacitor in each of the plurality of conditioning units.

In one example of the lighting system, individual conditioning units include the resonant capacitor, a rectifier, and a filter capacitor connected to receive charge from the resonant circuit when the selected predetermined frequency matches the resonant frequency of the conditioning unit. The individual conditioning units may include a frequency detector unit and a frequency switch. The frequency detector unit is configured to switch the frequency switch to enable charging of the filter capacitor when the selected frequency matches the resonant frequency of the conditioning unit and to switch the frequency switch to disable charging of the filter capacitor when the selected frequency does not match the resonant frequency of the conditioning unit.

The multi-frequency generator selects the frequency to generate from the plurality of frequencies using a control signal received from the controller. The multi-frequency generator may include a voltage controlled oscillator and generates the individual frequencies for a time duration according to the control signal. In one example, the multi-frequency generator generates frequencies in a selected sequence of frequencies, with each frequency being generated for the time duration corresponding to the frequency. The conditioning unit may include a filter capacitor connected to charge when the resonant frequency corresponding to the conditioning unit is generated by the multi-frequency generator and to couple the charge to corresponding lights at an intensity level relative to the time duration of the resonant frequency. The control signal, for example, may include a sequence of voltage levels corresponding to the sequence of frequencies with each voltage level having the desired time duration. The lights of the lighting assembly may include a plurality of sets of lights, with individual sets of lights connected to a corresponding conditioning unit and configured to radiate light having a distinct color or color temperature.

The transmitting coil may be positioned on one side of a wall and the receiving coil positioned on an opposite side of the wall such that the transmitting coil and receiving coil are inductively coupled across the wall. Individual lights may be adapted to respectively radiate light having a red color, a green color, and a blue color allowing for display from each of the primary colors thereby allowing for a plethora of colors to be radiated from the lighting assembly. Application of a wireless underwater boat lighting system may be employed with the transmitting coil housed within a transmitter module and the receiving coil housed within a separate receiver module. The transmitter module may be positioned on an inside of a boat hull with the receiver module positioned on the outside of the boat hull with the lights being powered without breaching the boat hull. With the transmitting coil positioned on the inside of the boat hull and the receiving coil positioned on the outside of the boat hull in sufficient proximity to the transmitting coil, the lights of the lighting assembly are able to be powered via an inductive coupling without breaching the boat hull.

A method for wirelessly powering a lighting assembly is also provided. A plurality of resonant circuits are formed with a transmitting coil, a receiving coil and a plurality of conditioning units. The individual conditioning units have a resonant capacitor and the individual resonant circuits have a distinct resonant frequency. Individual conditioning units are connected to a corresponding light. An oscillating signal having a selected frequency corresponding to a resonant frequency of a resonant circuit is coupled to the transmitting coil and the oscillating signal is inductively coupled to the receiving coil. The oscillating signal is received at the one of the plurality of conditioning units corresponding to the resonant circuit having the resonant frequency matching the selected frequency. A charge is coupled to the light corresponding to the one of the plurality of conditioning units.

A frequency of the oscillating signal is detected at each conditioning unit. As the frequency of the oscillating signal matches the resonant frequency of the corresponding conditioning unit, then coupling the charge for the corresponding conditioning unit is enabled. If the frequency of the oscillating signal does not match the resonant frequency of the corresponding conditioning unit, then coupling of the charge is disabled.

A control signal is coupled to a multi-frequency generator to select the frequency and to generate the oscillating signal at the selected frequency for a time duration indicted in the control signal. The control signal may include a sequence of the voltage levels, with individual voltage levels corresponding to one of the plurality of frequencies. A filter capacitor is charged using a DC power signal for the time duration of the selected frequency.

The lights of the lighting assembly may radiate light of a different color or color temperature. The intensity of the light generated by the lights may be adjusted by adjusting the amount of charge coupled to the light. The color or color temperature of the light generated by the lighting assembly may be adjusted by adjusting the time duration for each of the plurality of frequencies.

Other systems, methods and features of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The examples of the invention described below can be better understood with reference to the following figures. The components in the figures are not necessarily to scale or in their actual position in any given implementation, emphasis instead being placed upon illustrating the principles of the invention. In the figures, like reference numerals designate corresponding parts throughout the different views.

DETAILED DESCRIPTION

In the following description of example embodiments, reference is made to the accompanying drawings that form a part of the description, and which show, by way of illustration, specific example embodiments in which the invention may be practiced. Other embodiments may be utilized and structural changes may be made without departing from the scope of the invention.

Figure 1:
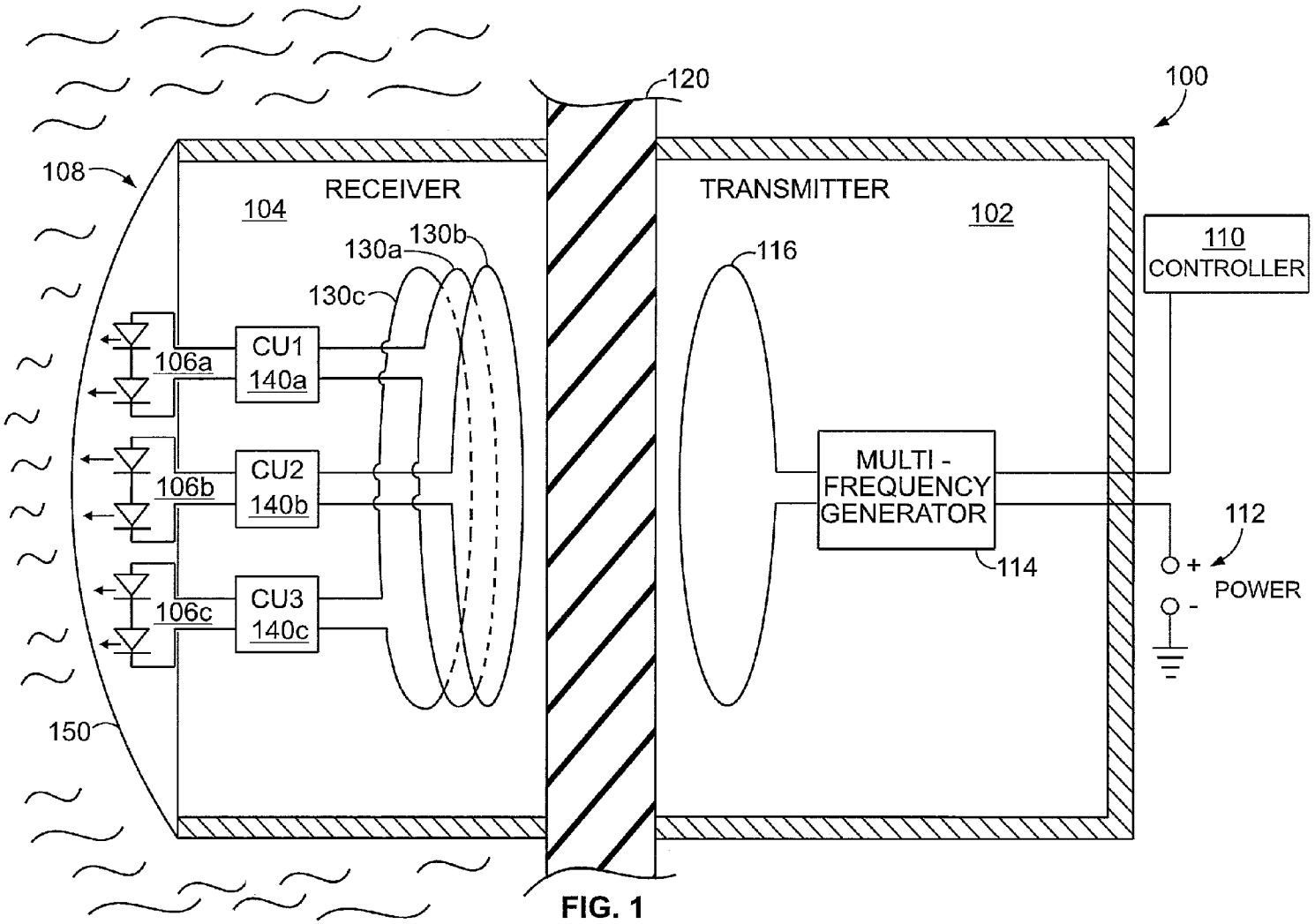
FIG. 1 is a schematic diagram of an example lighting system having underwater lights powered by electrical power from inside a submerged structure.

FIG. 1 is a schematic diagram of an example lighting system 100 having underwater lights powered by electrical power from inside a structure. The lighting system 100 in FIG. 1 operates on a boat with lights illuminating the area around the underwater portion of the boat where the lights are mounted. The lighting system 100 includes a power transmitter 102, a power receiver 104 and a plurality of lights 106*a*, 106*b*, 106*c* in a lighting assembly 108. The power transmitter 102, in the example shown in FIG. 1, is mounted on a boat hull 120 in the inside of the boat and the power receiver 104 is mounted on the boat hull 120 on the outside of the boat substantially aligned with the power transmitter 102. The power transmitter 102 is connected to a controller 110 and a power source 112 on the inside of the boat. The power transmitter 102 is configured to wirelessly deliver electrical power to the power receiver 104, which then powers the lights 106 in the lighting assembly 108. The wirelessly delivered electrical power removes the need to breach the boat hull 120 to power the lights in the lighting assembly 108.

The power transmitter 102 in the example lighting system 100 in FIG. 1 includes a multi-frequency generator 114 and a transmitting coil 116. The power transmitter 102 is connected to the controller 110, which provides the power transmitter 102 with signals indicative of the state of the lights and of the color that the lights are to have when the lights are turned on. In an example implementation, the controller 110 communicates an electrical control signal to the multi-frequency generator 114 that indicates a plurality of frequencies and a time duration for each frequency. The plurality of frequencies and duration for each frequency may be used as described below with reference to FIGS. 4A and 4B to indicate what color is to be radiated by the lights 106 in the lighting assembly 108.

The power transmitter 102 receives DC power from the power source 112. The power source 112 may be any suitable power source including an existing power source in the installation. For example, the lighting system 100 may be used in a boat and use a DC battery, DC generator or rectified AC power that may already be in use on the boat. The power transmitter 102 uses the DC power to generate the wireless power signal by means of an oscillating magnetic field to the power receiver 104. The wireless power signal includes energy from the DC power source 112 at a sequentially transmitted plurality of the frequencies indicated by the electrical control signal from the controller 110. Each frequency is generated for the time duration indicated in the electrical control signal for that frequency.

The controller 110 may be any computer-controlled device configured to generate the electrical control signal for controlling the lighting system 100. A dedicated controller 110 device may be used in the lighting system 100 to provide the control of the lighting system 100. The controller 110 may also be a separate computerized device configured with suitable software and hardware to output the electrical signal to the power transmitter 102.

The multi-frequency generator 114 receives the electrical control signal that indicates the frequencies and time durations and generates the power signal to the transmitting coil 116. The multi-frequency generator 114 may include any electrical circuitry configured to generate an oscillating signal that oscillates at one of the plurality of frequencies, each frequency at the time duration indicated in the electrical control signal.

The transmitting coil 116 receives the oscillating signal and radiates an oscillating magnetic field that matches the oscillating signal. The oscillating magnetic field is inductively coupled across the boat hull 120 to the power receiver 104.

The power receiver 104, in the example shown in FIG. 1, includes a plurality of receiver coils 130*a*, 130*b*, 130*c*, and a corresponding plurality of conditioning units 140*a*, 140*b*, 140*c*. As shown in FIG. 1, the power receiver 104 is affixed to the boat hull 120 on the side of the boat hull 120 that is submerged underwater. The power receiver 104 is affixed to the boat hull 120 such that it is sealed from the water. However, the boat hull 120 need not be breached in order to provide power to the lights 106. The power transmitter 102 and power receiver 104, for instance, may be individually housed in separate modules that may be affixed to the boat hull by water-proof adhesive or alternative non-invasive means to mount the power transmitter 102 and power receiver 104 without the need to breach the boat hull. Thus, as seen, the transmitting coil 116 may be positioned on one side of a wall 120 (such as a boat hull or other water tight barrier) and the receiving coils 130 positioned on an opposite side of the wall with the transmitting coil and receiving coils inductively coupled across the wall. Each conditioning unit 140*a*, 140*b*, 140*c* in the power receiver 104 is connected to a corresponding set of lights 106*a*, 106*b*, 106*c* in the lighting assembly 108. The power receiver 104 receives the oscillating magnetic field through the boat hull 120 and powers the lights in the lighting assembly 108 to shine with intensities that correspond to the frequencies and time durations for the frequencies indicated in the electrical control signal generated by the controller 110. In this configuration with the transmitting coil 116 housed within the transmitter module 102 positioned on the inside of the boat hull 120 and the receiving coils 130 housed within the receiver module 104 positioned on the outside of the boat hull, each of the lights 106*a*, 106*b*, 106*c* are able to be powered without breaching the boat hull.

The receiver coils 130*a*, 130*b*, 130*c* generate an oscillating signal that corresponds to the oscillating magnetic field generated by the transmitting coil 116 in the power transmitter 102. Each receiver coil 130*a*, 130*b*, 130*c* couples the oscillating signal it generates to the corresponding conditioning unit 140*a*, 140*b*, 140*c* to which the receiver coil 130*a*, 130*b*, 130*c* is connected.

The conditioning units 140*a*, 140*b*, 140*c* receive the oscillating signal from the corresponding receiver coils 130*a*, 130*b*, 130*c*. Depending on the frequency of the oscillating signal, an electrical power signal is generated by each conditioning unit 140*a*, 140*b*, 140*c* to power the light or set of lights to which the conditioning unit is connected 140*a*, 140*b*, 140*c*.

The lighting assembly 108 shown in FIG. 1 includes a plurality of sets of lights 106*a*, 106*b*, 106*c* enclosed by a lens 150. The plurality of sets of lights 106*a*, 106*b*, 106*c* are connected to receive power signals from each corresponding conditioning unit 140*a*, 140*b*, 140*c*. The plurality of sets of lights 106*a*, 106*b*, 106*c* may be sets of one or more LEDs or any other type of light that may be powered by a DC signal. The LEDs may be LEDs of different colors.

The lighting system 100 in FIG. 1 provides a wireless power delivery to lights mounted on the submerged portion of a boat hull 120 without requiring any opening in the boat hull 120. In an example implementation, the transmitting coil 116, the plurality of receiver coils 130*a*, 130*b*, 130*c*, and the conditioning units 140*a*, 140*b*, 140*c* (through a capacitor in each conditioning unit) form resonant circuits. Each resonant circuit powers a corresponding set of the lights 106*a*, 106*b*, 106*c*.

For example, the transmitting coil 116, the first receiver coil 130*a*, and the first conditioning unit 140*a* form a first resonant circuit having a first matching frequency. The transmitting coil 116, the second receiver coil 130*b*, and the second conditioning unit 140*b* form a second resonant circuit having a second matching frequency. The transmitting coil 116, the third receiver coil 130*c*, and the third conditioning unit 140*c* form a third resonant circuit having a third matching frequency. When the frequency of the oscillating signal at the transmitting coil 116 is at the first matching frequency, the first conditioning unit 140*a* generates a power signal that turns the first set of lights 106*a* 'on.' When the frequency of the oscillating signal at the transmitting coil 116 is at the second matching frequency, the second conditioning unit 140*b* generates a power signal that turns the second set of lights 106*b* 'on.' When the frequency of the oscillating signal at the transmitting coil 116 is at the third matching frequency, the third conditioning unit 140*c* generates a power signal that turns the third set of lights 106*c* 'on.' The intensity of the light output by the lights 106*a*, 106*b*, 106*c* may be controlled by the time duration of the corresponding matching frequencies.

Figure 2:
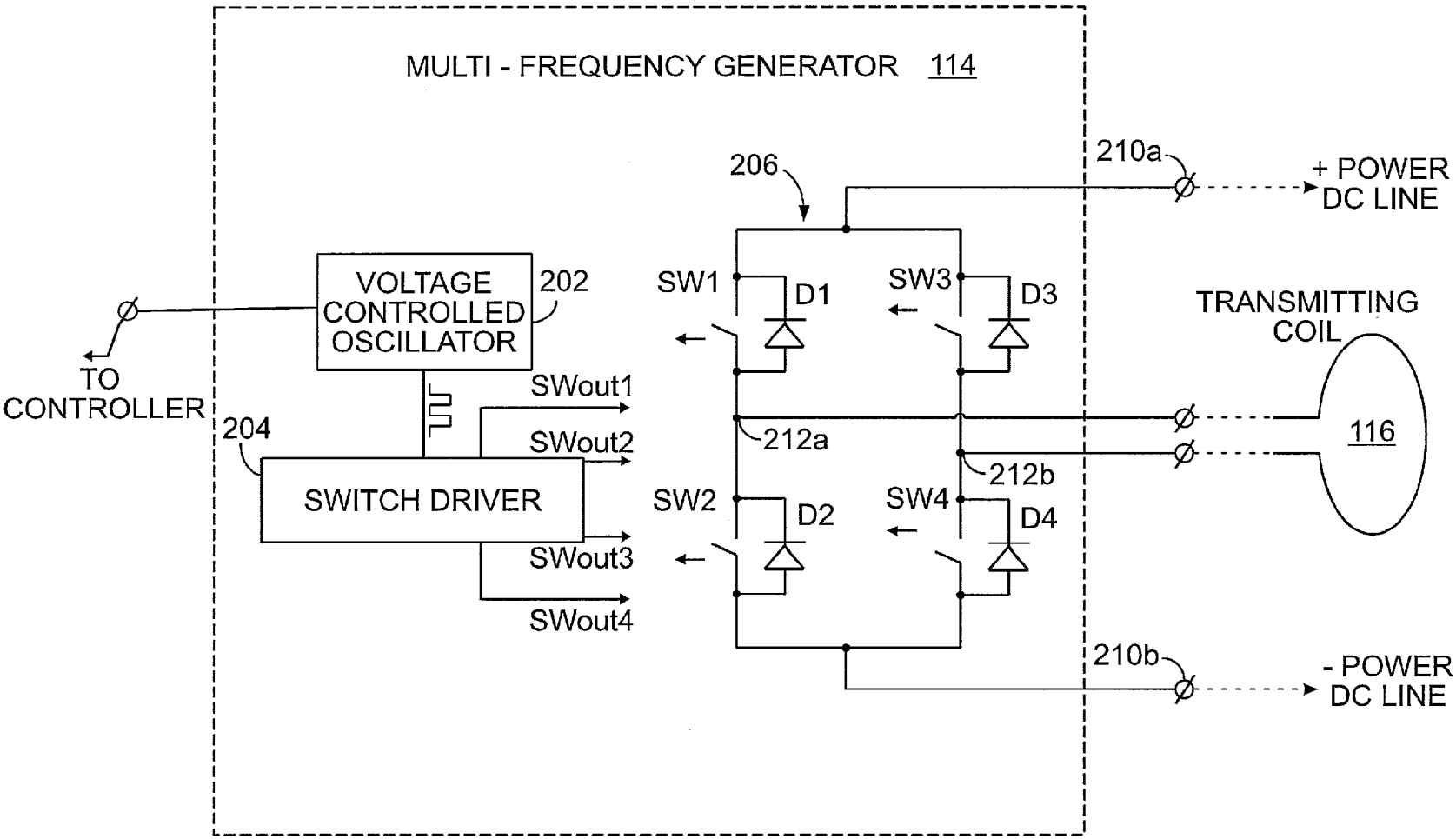
FIG. 2 is a schematic diagram of an example of a multi-frequency generator of a type that may be used in the lighting system in FIG. 1.

FIG. 2 is a schematic diagram of an example of a multi-frequency generator of a type that may be used in the lighting system in FIG. 1. The multi-frequency generator 114 shown in FIG. 2 includes a voltage-controlled oscillator ("VCO") 202, a switch driver 204, a switching bridge 206, and a DC power connection 210. The multi-frequency generator 114 receives the electrical control signal from the controller 110 and couples the signal to the VCO 202.

The VCO 202 may be any suitable voltage-controlled oscillator, which is a type of circuit that generates a signal having a frequency based on the level of the input signal. In the VCO 202 in FIG. 2, the electrical control signal input at the VCO 202 may have a voltage level $V_1$, and the VCO 202 may be configured to generate an output signal having a frequency $f_1$ that corresponds to the voltage level $V_1$. When the electrical control signal changes to a different voltage level, $V_2$, the VCO 202 generates a corresponding second output signal having a frequency $f_2$. The VCO 202 may be configured to generate an output signal having a plurality of frequencies corresponding to the voltage level of the electrical control signal. In an example implementation, the VCO 202 generates a DC square wave alternating between a HIGH level and a LOW level at a frequency that corresponds to the voltage level at the VCO 202 input.

The output signal of the VCO 202 is coupled to the switch driver 204, which includes switch outputs SWOUT1, SWOUT 2, SWOUT 3, and SWOUT 4 coupled to corresponding switches in the switching bridge 206. The switching bridge 206 includes switches SW1, SW2, SW3, and SW4 paired with corresponding flyback diodes D1, D2, D3, and D4. The switching bridge 206 is connected to the DC power source at a (+) terminal 210*a* and a (−) terminal 210*b* and to opposite ends of the transmitting coil 116.

The switch driver 204 operates the switches SW1, SW2, SW3, and SW4 in the switching bridge 206 to generate an oscillating signal to the transmitting coil 116. The switch driver 204 may receive the DC square wave having a desired frequency from the VCO 202 and alternately enable the switch outputs SWOUT1, SWOUT 2, SWOUT 3, and SWOUT 4 in a predetermined pattern. For example, the switch driver 204 receives the DC square wave and may simultaneously output a 'switch ON' signal at switch outputs SW1 and SW4, and a 'switch OFF' signal at switch outputs SW2 and SW3 at the high level of the DC square wave. When switch SW1 is 'ON,' the (+) terminal 210*a* of the power source 112 is connected to a first end 212*a* of the transmitting coil 116, and when SW4 is 'ON,' the (−) terminal 210*b* of the power source 112 is connected to the other end 212*b* of the transmitting coil 116. This couples the DC power source 112 directly across the transmitting coil 116 for a time during which switches SW1 and SW4 remain in the 'ON' state. The switch driver 204 may then flip the states of the switch outputs to flip the power terminal connections to the transmitting coil 116. The switch driver 204 flip may be performed by simultaneously outputting a 'switch OFF' signal at switch outputs SWOUT1 and SWOUT4, and a 'switch ON' signal at switch outputs SWOUT2 and SWOUT3. This flips the power terminal connections to the transmitting coil 116. Switch SW2 is 'ON' to couple the (−) terminal 210*b* of the power supply 112 to the first end 212*a* of the transmitting coil 116, and switch SW3 is 'ON' to couple the (+) terminal 210*a* of the power supply 112 to the other end 212*b* of the transmitting coil 116. The power supply voltage remains on the transmitting coil 116, but with the polarities switched.

The switch driver 204 is configured to cycle the switch outputs SWOUT1, SWOUT2, SWOUT3, and SWOUT4 according to the frequency of the DC square wave input to the switch driver 204. The cycling of the switch outputs causes the polarities of the power supply 112 coupled to the transmitting coil 116 via the switching bridge 206 to alternate to transfer an AC (alternating current) signal to the transmitting coil 116. The AC signal on the transmitting coil 116 oscillates at the frequency of the DC square wave generated by the VCO 202.

Figure 3:
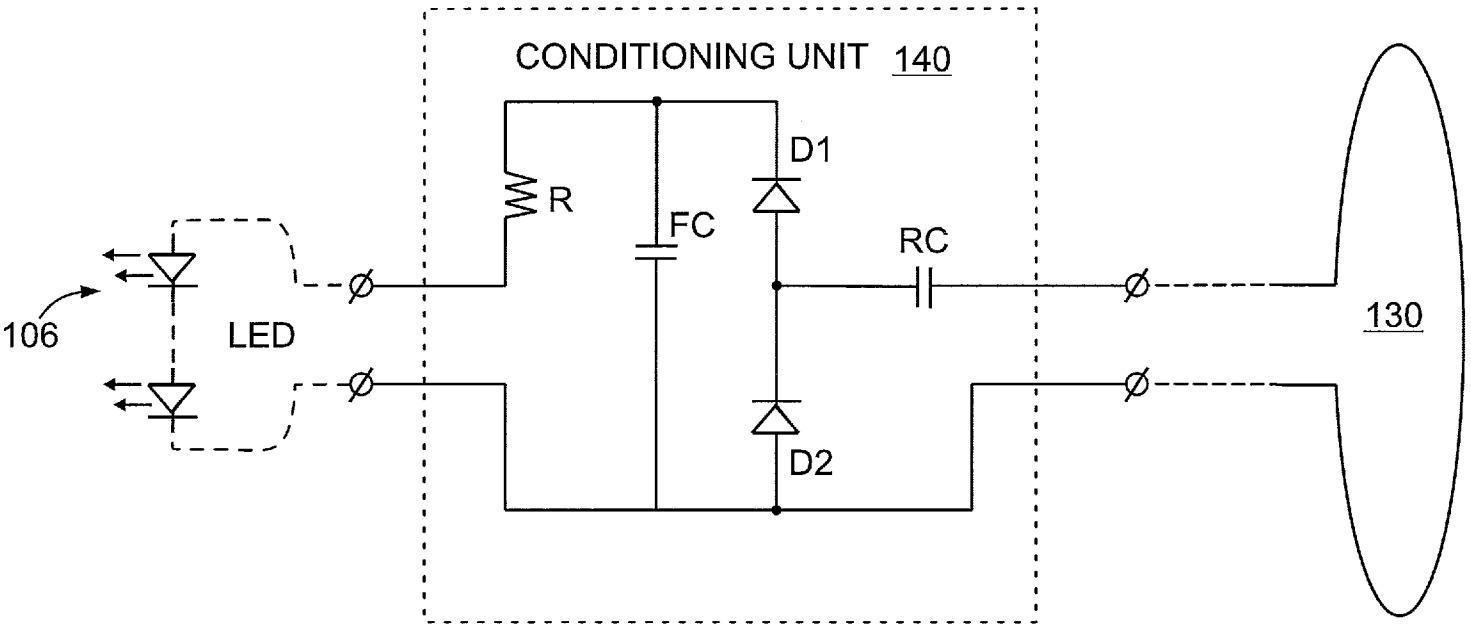
FIG. 3 is a schematic diagram of an example of a conditioning unit of a type that may be used in the lighting system in FIG. 1.

FIG. 3 is a schematic diagram of an example of the conditioning unit 140 that may be used in the lighting system 100 in FIG. 1. The conditioning unit 140 is connected to the receiving coil 130 and a corresponding set of lights 106. The conditioning unit 140 includes a resonant capacitor RC connected in series with the coil 130 and between two rectifier diodes D1 and D2. The diode D1 is connected to a filter capacitor FC, which is connected in parallel with the rectifier diodes D1 and D2. The filter capacitor FC is also connected across the outputs of the conditioning unit 140, which are connected to the set of lights 106.

The receiving coil 130 receives an AC signal via inductive coupling with the transmitting coil 116 on the other side of the boat hull 120 (FIG. 1). The transmitting coil 116, the receiving coil 130, and the resonant capacitor RC in the conditioning unit 140 form a resonant circuit. If the frequency of the AC signal coupled to the receiving coil 130 matches the resonant frequency of the resonant circuit, the AC signal is coupled to the node between the rectifier diodes D1 and D2. The rectifier diodes D1 and D2 convert the AC signal to a DC signal at a voltage level sufficient to light the lights 106. The rectifier diodes D1 and D2 charge the filter capacitor FC to provide the current to light the LEDs connected to the conditioning unit 140.

Each set of lights 106 shown in FIG. 1 is coupled to corresponding conditioning units 140. The components in the conditioning units 140 and the receiving coil 130 are selected to have inductance, capacitance and resistance values that, together with the transmitting coil 116, indicate a resonant frequency that is unique for each conditioning unit 140. The set of lights 106 that are to be turned on may be selected by selecting one of the possible resonant frequencies. The multi-frequency generator 114 in the transmitter unit 102 selects the resonant frequency to couple to the transmitting coil 116 in accordance with the electrical control signal received from the controller 110 (in FIG. 1).

The electrical control signal may indicate different frequencies to couple to the transmitting coil 116 at different times. For example, one frequency may be selected to turn one set of lights 106 on for one time duration, then switch to a different frequency to turn a different set of lights 106 on for a next time duration. The conditioning units 140 may be connected to sets of lights 106 that illuminate in different colors. The process of switching to different frequencies to turn on different sets of lights 106 of different colors may be controlled to expand the range of colors that may be illuminated by the combination of the lights 106. By varying the time durations of each frequency, the sets of lights 106 may illuminate at different intensities further expanding the range of colors that may be illuminated by the lights 106. In an example that includes three sets of lights that radiate red, green, and blue light, the intensities of the sets of lights may be varied to generate light in a diverse palette of colors. An example of how the lighting system 100 in FIG. 1 may be used to output light in different colors is described with reference to FIGS. 4A and 4B.

It is noted that the control achieved by varying time durations and frequencies may be utilized for lighting assemblies having lights of the same color but different color temperatures. For example, a lighting assembly may include multiple sets of LEDs that radiate light of the same color and each set may include LEDs that radiate the light at different color temperatures. To illustrate in a more specific example, the lighting assembly may include three groups of LEDs that radiate white light where one group radiates cool white light, a second group radiates warm white light, and the third group may radiate white light that is between cool and warm. In this example, the three sets of lights may be powered by corresponding conditioning units identified by three corresponding resonant frequencies. By varying the intensity of the light generated by each set of LEDs, the lighting assembly may be controlled to generate white light having virtually any desired color temperature.

Figure 4A:
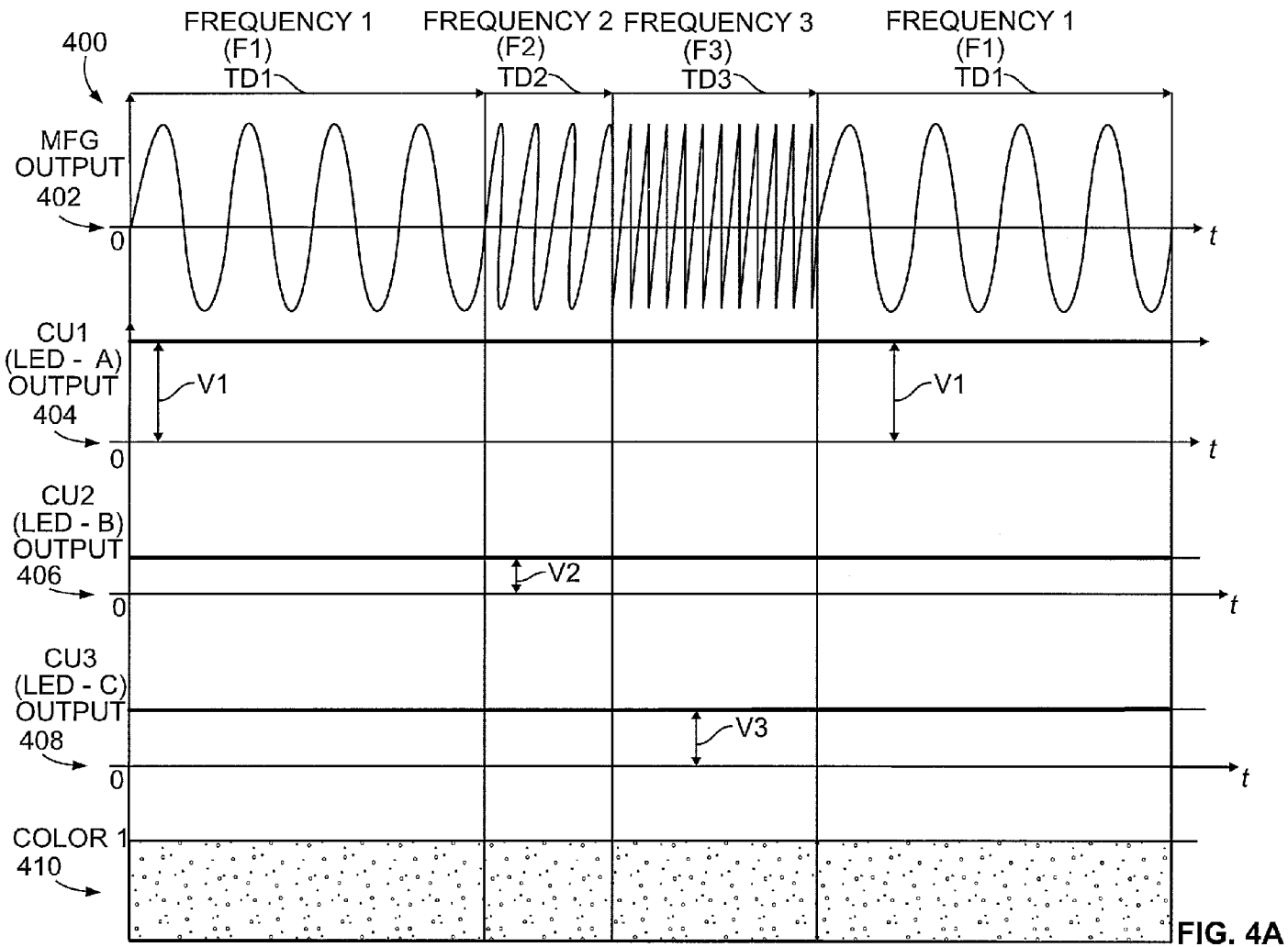
FIGS. 4A and 4B are graphs illustrating power delivery to a light assembly using an example of the lighting system shown in FIG. 1.
Figure 4B:
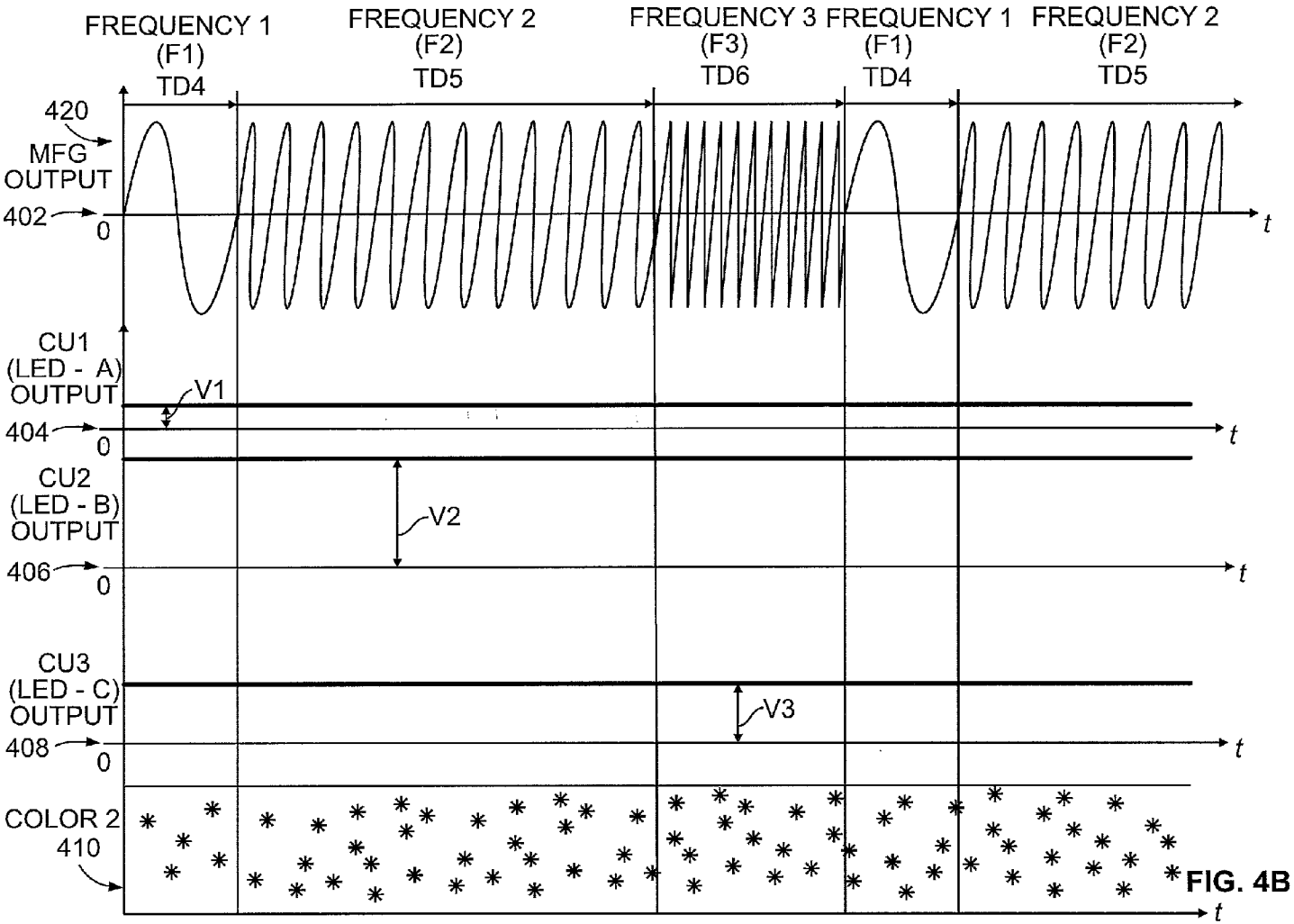

FIGS. 4A and 4B are graphs illustrating power delivery to an underwater lighting system from an internal power source using an example of the lighting system shown in FIG. 1. FIG. 4A illustrates an example of a first set of graphs 400 showing the result of a light output when the multi-frequency generator 114 (in FIG. 1) generates frequency values F1, F2, and F3 for time durations TD1, TD2, and TD3. FIG. 4B illustrates an example of the set of graphs 420 of a light output when the multi-frequency generator 114 (in FIG. 1) generates the same frequency values F1, F2, and F3 for time durations TD4, TD5, and TD6.

It is noted that the graphs in FIGS. 4A and 4B illustrate hypothetical examples that do not have specific values set for the frequencies, time slots, voltage levels, colors, or other parameters. Specific values would depend on the requirements, components, and other implementation-specific design factors.

It is also noted that the graphs 400, 420 in FIGS. 4A & 4B are for an implementation using three LEDs or sets of LEDs indicated in FIGS. 4A & 4B as LED-A, LED-B, and LED-C. Each of the three LED lights may respectively radiate light in one of the three primary colors (red, blue and green). By modifying the time duration of each frequency generated in the manner described below, the intensity of the light output of the three primary color LEDs may be modified to configure the light assembly 106 to radiate light of different colors.

The graphs 400 in FIG. 4A include a multi-frequency generator output graph 402, a first conditioning unit (CU1) output graph 404, a second conditioning unit (CU2) output graph 406, a third conditioning unit (CU3) output graph 408, and a light color output graph 410. The multi-frequency generator output graph 402 shows an output at a first frequency F1 during the first time duration TD1, an output at a second frequency F2 during second time duration TD2, and an output at a third frequency F3 during third time duration TD3. The three frequency values are illustrated as being different from one another. The frequencies F1, F2, F3 are the matching frequencies of the resonant circuits formed with each conditioning unit (CU1, CU2, CU3). When the multi-frequency generator 114 (in FIG. 1) outputs the frequency that matches the resonant circuit for a given conditioning unit 130 (in FIG. 1), the set of lights 106 that is connected to the given conditioning unit 130 is the set of lights that is turned 'ON.'

The time duration at which each frequency is output by the multi-frequency generator 114 (in FIG. 1) may be varied to control the intensity at which each light source generates light. As shown in the example in FIG. 4A, the multi-frequency generator 114 outputs the first frequency F1 for the time duration TD1. During time duration TD1, the first conditioning unit output graph 404 shows an output by the CU1 to LED-A at a first signal level V1. The multi-frequency generator 114 then switches the frequency of the signal to output the second frequency F2 for the time duration TD2. During time duration TD2, the second conditioning unit output graph 406 shows an output by the CU2 to LED-B at a second signal level V2. The multi-frequency generator output 402 then switches the frequency of the signal to output the third frequency F3 for the time duration TD3. During time duration TD3, the third conditioning unit output graph 408 shows an output by the CU3 to LED-C at a third signal level V3.

The order of the time durations shown in FIG. 4A is: TD1>TD3>TD2. As shown by the first conditioning unit CU1 output graph 404, the conditioning unit CU1 corresponding to the first frequency F1 generates the highest signal level V1 to power the LED-A based on the longest time duration TD1 relative to the other three time durations. As shown by the third conditioning unit CU3 output graph 408, the conditioning unit CU3 corresponding to the third frequency F3 generates the next highest signal level V3 to power the LED-C based on the next longest time duration TD3 relative to the other three time durations. As shown by the second conditioning unit CU2 output graph 406, the conditioning unit CU2 corresponding to the second frequency F2 generates the lowest signal level V2 to power the LED-B based on the shortest time duration TD2 relative to the other three time durations.

The signal levels V1, V2, V3 correspond to the light intensities of the light output by the corresponding sets of lights 106 (in FIG. 1). The combination of the light output of each set of lights 106*a-c* (in FIG. 1) may result in a first color COLOR1 as shown at 410. The signal levels V1, V2, V3 may be adjusted by varying the time durations to vary the intensities of the lights 106 and accordingly the color radiated. The time durations TD1, TD2, TD3 may cycle in the order shown in FIG. 4A for as long as the color (COLOR1) 410 to be radiated. It is noted that the signals shown in FIG. 4A reflect a steady state condition in which the time durations TD1, TD2, TD3 have cycled past the change in intensity of the lights 106 that occurs when the time durations are switched to the indicated time durations TD1, TD2, TD3.

FIG. 4B illustrates a variation of the time durations TD4, TD5, TD6 relative to each other. As shown in FIG. 4B, the first frequency F1 is generated for a shortened time duration TD4. The second frequency F2 is generated for a lengthened time duration TD5. The third frequency F3 is generated for a relatively similar time duration TD6. The order of the time durations at the multi-frequency generator output 114 in the graphs in 420 is as follows: TD5>TD6>TD4. The first conditioning unit output graph 404, the second conditioning unit output graph 406, and the third conditioning unit output graph 408 in the graphs 420 in FIG. 4B illustrate a changed order in the relative intensities corresponding to the time durations as follows: V2>V3>V1. The new combination of light intensities results in a different color output COLOR2 at 410.

Figure 5:
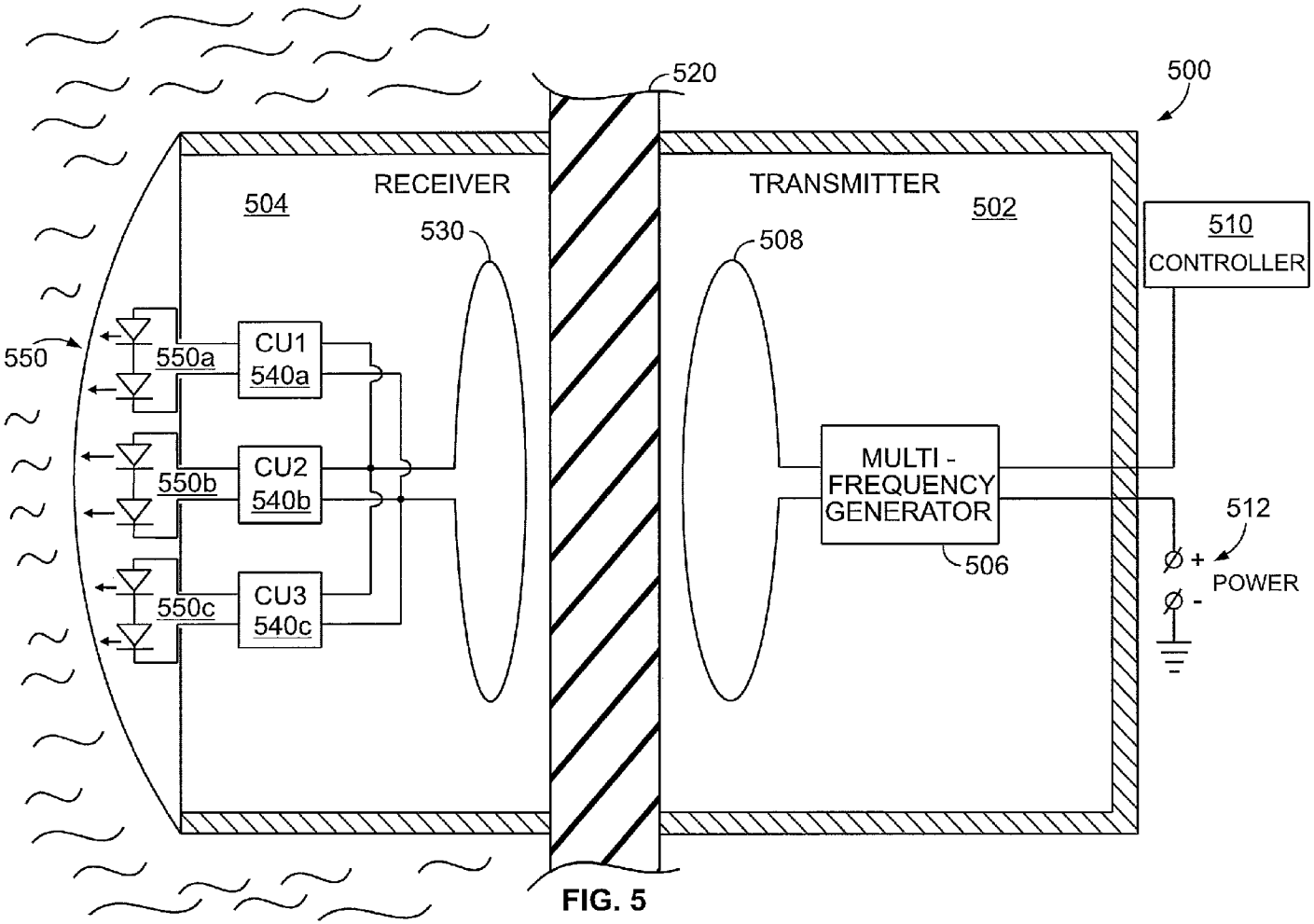
FIG. 5 is a schematic diagram of another example lighting system having underwater lights powered by electrical power from inside a submerged structure.

FIG. 5 is a schematic diagram of another example lighting system 500 having underwater lights powered by electrical power from inside a submerged structure. The lighting system 500 in FIG. 5 includes a power transmitter 502, and a power receiver 504 mounted on the submerged side of the boat hull 520 to power a lighting assembly 550. The power transmitter 502 includes a multi-frequency generator 506, and a transmitting coil 508. The multi-frequency generator 506 receives an electrical control signal from a controller 510 and a DC power signal from a power source 512.

The power receiver 504 includes a single receiver coil 530, and three conditioning units 540*a*, 540*b*, 540*c*, each connected to a corresponding set of lights in the lighting assembly 550. The single receiver coil 530 in the lighting system 500 in FIG. 5 is connected to all three conditioning units 540*a*, 540*b*, 540*c*. The power receiver 504 and power transmitter 502 in FIG. 5 operate in a manner similar to that of the lighting system 100 in FIG. 1. In the lighting system 500 in FIG. 5, however, the resonant circuits that power each of the sets of lights 550 are formed by the transmitting coil 508, the single receiver coil 530, and a resonant capacitor in each conditioning unit 540*a*, 540*b*, 540*c*. The operation of the lighting system 500 in FIG. 5 may substantially conform to the description of the operation of the lighting system 100 provided above. In example implementations of the lighting system 500 in FIG. 5, the conditioning units 540*a*, 540*b*, 540*c* may be implemented with selective frequency detection capabilities.

Figure 6:
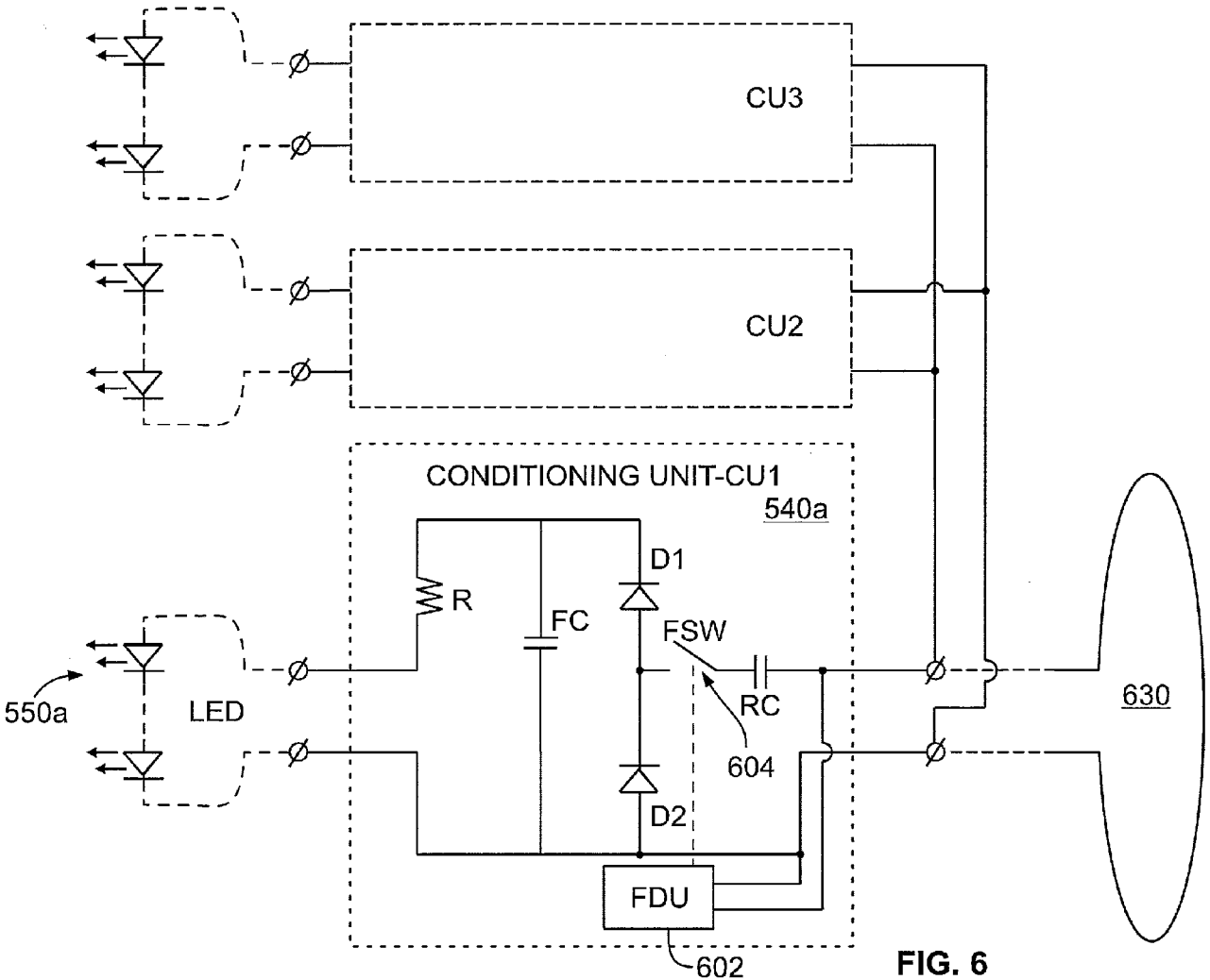
FIG. 6 is a schematic diagram of an example of a conditioning unit of a type that may be used in the lighting system in FIG. 5.

FIG. 6 is a schematic diagram of an example of the conditioning unit 540*a* that may be used in the lighting system 500 in FIG. 5. The conditioning unit 540 is connected to the receiving coil 630 and a corresponding set of lights 550*a*. The conditioning unit 540*a* includes a resonant capacitor RC, a rectifier formed by diodes D1 and D2, a frequency detection unit (FDU) 602, a frequency switch (FSW) 604, a filter capacitor FC, and a resistor R in series with the lights 550*a*.

The resonant capacitor RC in the conditioning unit 540*a* shown in FIG. 6 is connected in series with the coil 630 and the frequency switch 604, which is connected in series with the resonant capacitor RC and the node between diodes D1 and D2. The diode D1 is connected to charge the filter capacitor FC when the frequency switch 604 is closed in the ON state. The frequency switch 604 is triggered by the FDU 602, which is connected in parallel with the single receiving coil 630. The FDU 602 is configured to switch the frequency switch 604 to the ON state when the transmitting frequency matches the resonant frequency determined by the resonant parameters of the conditioning unit 540*a*. The FDU 602 sets the frequency switch 604 to the OFF state when the transmitting frequency is any other frequency. The filter capacitor FC is charged by the rectifier while the frequency switch 604 is in the ON state. The charged filter capacitor FC dissipates the charge as current that powers the lights 550*a*.

The FDU 602 may be any suitable electronic circuit that senses the frequency of the signal at the receiving coil 630 and outputs a signal indicating a match between the sensed frequency and a predetermined frequency, which is the resonant frequency in the illustrated example. A variety of circuits may be implemented to sense the frequency and generate the appropriate output signal. One example of a circuit that may be used as the FDU 602 includes a frequency comparator, which may use two counters. One counter counts pulses from a preset frequency generator that has been pre-set to the frequency that should match the resonant frequency of the corresponding conditioning unit 540*a*. The other counter counts pulses from the receiving coil 630. The frequency of the pulses from the receiving coil 630 depends on the oscillating frequency of the multi-frequency generator 506. The resonant frequency (first counter) and the receiving coil frequency (second counter) are equal when the counter values are the same for any set period of time. The frequency comparator activates the output of the FDU 602, which in turn triggers the frequency switch 604. The frequency Switch 604 closes the line from the receiving coil 630 to the conditioning unit 540*a* with the matching frequency. The other conditioning units 540*b*, 540*c* remain unconnected to the receiving coil 630. Use of the FDU 602 prevents interference between the conditioning units 540*a,b,c*.

The filter capacitor FC is charged by the rectifier as long as the FDU 602 detects that the transmitting frequency matches the resonant frequency of the conditioning unit 540*a*. When a different frequency is detected, the frequency switch 604 is turned to the OFF state, which stops the charging of the filter capacitor FC and interrupts the resonance processes in the conditioning unit 540*a*. However, any charge remaining in the filter capacitor FC will continue to be dissipated to the lights 550*a*.

Figure 7:
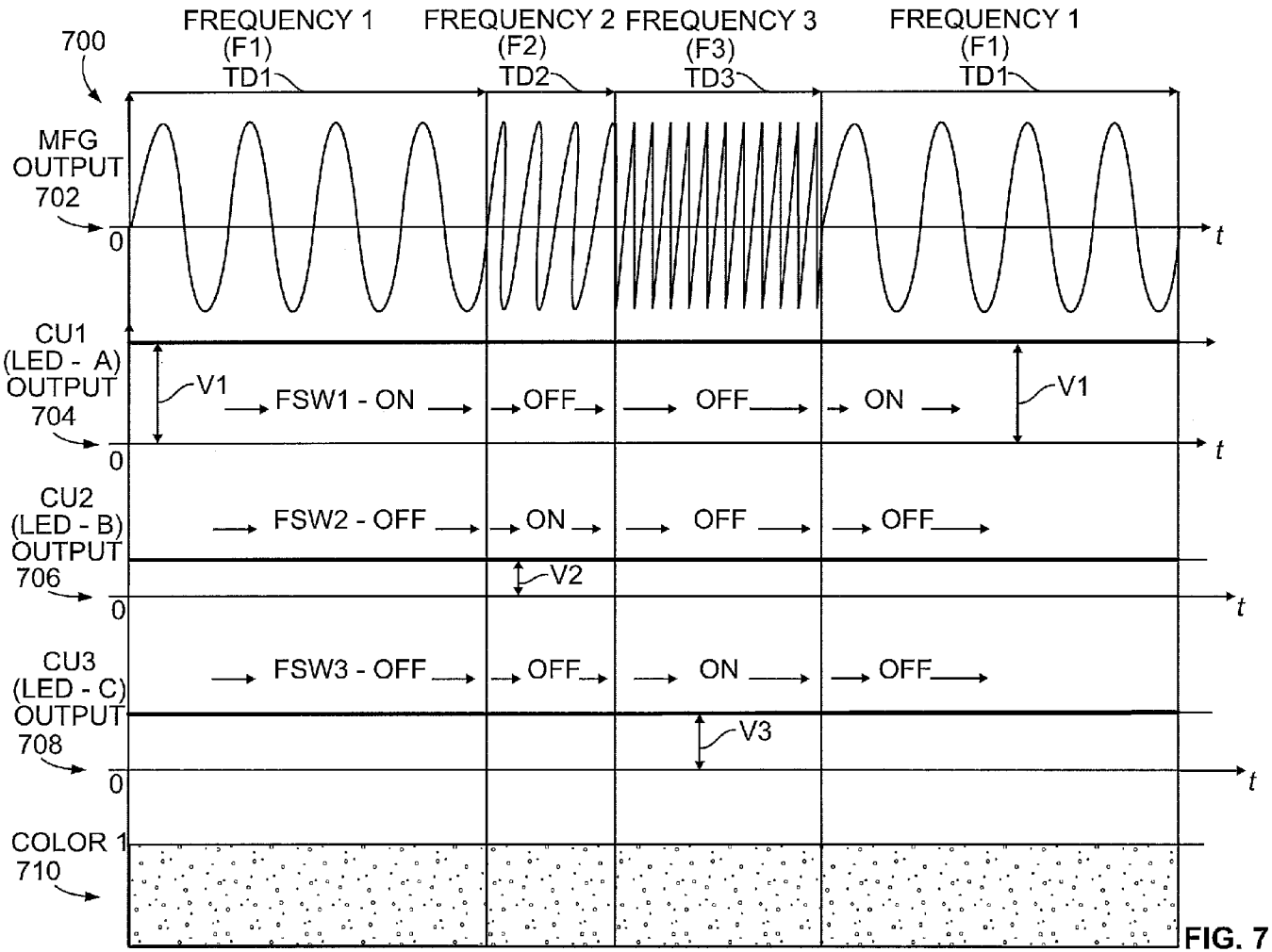
FIG. 7 is a set of graphs illustrating power delivery to a light assembly using an example of the lighting system shown in FIG. 5.

FIG. 7 is a set of graphs illustrating power delivery to a light assembly using an example of the lighting system 500 shown in FIG. 5 using the conditioning unit 540 illustrated in FIG. 6. The graphs in FIG. 7 include a multi-frequency generator output graph 702, a first conditioning unit (CU1) output graph 704, a second conditioning unit (CU2) output graph 706, a third conditioning unit (CU3) output graph 708, and a light color graph 710. The multi-frequency generator output graph 702 shows the frequencies F1, F2, F3 output by the multi-frequency generator 506 (in FIG. 5) during three time durations TD1, TD2, TD3.

During the first time duration TD1, the first conditioning unit output graph 704 indicates that frequency F1 is a match for the first conditioning unit CU1 resulting in the ON status of frequency switch SW1 604 (in FIG. 6). While the frequency switch SW1 is ON, the conditioning unit CU1 generates a voltage output to LED-A at a first signal level V1. During the second and third time durations, TD2 and TD3, the frequency switch SW1 in the first conditioning unit CU1 is in the OFF state. The multi-frequency generator 506 in FIG. 5 switches the frequency of the signal to output the second frequency F2 for the time duration TD2. During the time duration TD2, the second conditioning unit output graph 706 indicates that frequency F2 is a match for the second conditioning unit CU2 resulting in the ON status of frequency switch SW2. While the frequency switch SW2 is ON, the conditioning unit CU2 generates a voltage output to LED-B at a second signal level V2. At the end of time duration TD2, the multi-frequency generator output 506 switches the frequency of the signal to output the third frequency F3 for the time duration TD3. During the time duration TD3, the third conditioning unit output graph 708 indicates that frequency F3 is a match for the third conditioning unit CU3 resulting in the ON status of frequency switch SW3. While the frequency switch SW3 is ON, the conditioning unit CU3 generates a voltage output to LED-C at a third signal level V3.

It is noted that the conditioning unit 540 may be used with the lighting system 100 shown in FIG. 1 as an alternative to the conditioning unit 140 (in FIGS. 1 & 3). The conditioning unit 540 may be a more suitable alternative in implementations in which the receiving coils 130 (in FIG. 1) are positioned in close proximity to each other. Using the conditioning unit 540 in lighting system 100 shown in FIG. 1 reduces the effects of mutual inductance of the receiving coils.

It will be understood that the foregoing description of numerous implementations has been presented for purposes of illustration and description. It is not exhaustive and does not limit the claimed inventions to the precise forms disclosed. Modifications and variations are possible in light of the above description or may be acquired from practicing the invention. The claims and their equivalents define the scope of the invention.

What is claimed is:

1. A lighting system comprising:

a multi-frequency generator connected to a power source and a controller, the multi-frequency generator configured to generate an oscillating signal at a selected one of a plurality of frequencies according to a control signal received from the controller;

a transmitting coil connected to receive the oscillating signal;

a receiving coil positioned so that an inductive coupling is formed with the transmitting coil; and a plurality of conditioning units connected to the receiving coil to receive the oscillating signal, and to a corresponding plurality of lights, individual ones of the plurality of conditioning units configured to power a corresponding at least one of the plurality of lights when the selected one of the plurality of frequencies matches a resonant frequency of one of a plurality of resonant circuits formed by the receiving coil, the transmitting coil, and a resonant capacitor in each of the plurality of conditioning units.

2. The lighting system of claim 1 where:

the lights in the plurality of lights includes a plurality of sets of lights, individual sets of lights connected to a corresponding one of the conditioning units.

3. The lighting system of claim 2 where the individual sets of the plurality of sets of lights radiate light of either a different color or a different color temperature.

4. The lighting system of claim 1 where individual ones of the plurality of conditioning units include the resonant capacitor, a rectifier, and a filter capacitor connected to receive charge from the resonant circuit when the selected one of the predetermined frequencies matches the resonant frequency of the conditioning unit.

5. The lighting system of claim 4 where individual ones of the plurality of conditioning units include:

a frequency detector unit and a frequency switch, the frequency detector unit configured to switch the frequency switch to enable charging of the filter capacitor when the selected one of the plurality of frequencies matches the resonant frequency of the conditioning unit and to switch the frequency switch to disable charging of the filter capacitor when the selected one of the plurality of frequencies does not match the resonant frequency of the conditioning unit.

6. The lighting system of claim 1 where the multi-frequency generator selects the frequency to generate from the plurality of frequencies using a control signal received from the controller.

7. The lighting system of claim 6 where the multi-frequency generator includes a voltage-controlled oscillator.

8. The lighting system of claim 6 where the multi-frequency generator generates individual ones of the plurality of frequencies for a time duration according to the control signal.

9. The lighting system of claim 8 where the lights in the plurality of lights includes a plurality of sets of lights, individual sets of lights connected to a corresponding one of the conditioning units and configured to radiate light having either a distinct color or color temperature.

10. The lighting system of claim 9 where:

the multi-frequency generator generates the plurality of frequencies in a selected sequence of frequencies, each frequency being generated for the time duration corresponding to the frequency;

where the conditioning units include a filter capacitor connected to charge when the resonant frequency corresponding to the conditioning unit is generated by the multi-frequency generator and to couple the charge to the corresponding lights at an intensity level relative to the time duration of the resonant frequency; and where the control signal includes a sequence of voltage levels corresponding to the sequence of frequencies, each voltage level having the desired time duration.

11. The lighting system of claim 1 where the transmitting coil is adapted to be positioned on one side of a wall and the receiving coil is adapted to be positioned on an opposite side of the wall such that the transmitting coil and the receiving coil are inductively coupled across the wall.

12. The lighting system of claim 11 where the plurality of lights include at least three lights adapted to respectively radiate light having a red color, a green color, and a blue color.

13. The lighting system of claim 1 where the transmitting coil is housed within a transmitter module and the receiving coil is housed within a receiver module, the transmitter module adapted to be positioned on an inside of a boat hull and the receiver module adapted to be positioned on an outside of the boat hull such that the plurality of lights are able to be powered without breaching the boat hull.

14. The lighting system of claim 1 where the transmitting coil is positioned on an inside of a boat hull and the receiving coil is positioned on an outside of the boat hull in sufficient proximity to the transmitting coil to power the plurality of lights via inductive coupling without breaching the boat hull.

15. A lighting system comprising:

a multi-frequency generator connected to a controller, the multi-frequency generator configured to generate an oscillating signal at a selected one of a plurality of frequencies according to a control signal received from the controller;

a transmitting coil connected to receive the oscillating signal;

a plurality of receiving coils positioned so that an inductive coupling is formed between the plurality of receiving coils and the transmitting coil; and a plurality of conditioning units connected to corresponding receiving coils to receive the oscillating signal, and to a corresponding plurality of lights, individual ones of the plurality of conditioning units configured to power a corresponding at least one of the plurality of lights when the selected one of the plurality of frequencies matches a resonant frequency of one of a plurality of resonant circuits formed by the plurality of receiving coils, the transmitting coil, and a resonant capacitor in each of the plurality of conditioning units.

16. The lighting system of claim 15 where:

the lights in the plurality of lights includes a plurality of sets of lights, individual sets of lights connected to a corresponding one of the conditioning units.

17. The lighting system of claim 16 where the individual sets of lights radiate light of either a different color or a different color temperature.

18. The lighting system of claim 15 where individual ones of the plurality of conditioning units include the resonant capacitor, a rectifier, and a filter capacitor connected to receive charge from the resonant circuit when the selected one of the predetermined frequencies matches the resonant frequency of the conditioning unit.

19. The lighting system of claim 18 where individual ones of the plurality of conditioning units include:

a frequency detector unit and a frequency switch, the frequency detector unit configured to switch the frequency switch to enable charging of the filter capacitor when the selected one of the plurality of frequencies matches the resonant frequency of the conditioning unit and to switch the frequency switch to disable charging of the filter capacitor when the selected one of the plurality of frequencies does not match the resonant frequency of the conditioning unit.

20. The lighting system of claim 15 where the multi-frequency generator selects the frequency to generate from the plurality of frequencies using a voltage level in the control signal received from the controller.

21. The lighting system of claim 20 where the multi-frequency generator includes a voltage-controlled oscillator.

22. The lighting system of claim 20 where the multi-frequency generator generates individual ones of the plurality of frequencies for a time duration according to the control signal.

23. The lighting system of claim 22 where the lights in the plurality of lights includes a plurality of sets of lights, individual sets of lights connected to a corresponding one of the conditioning units and configured to radiate light having either a distinct color or a different color temperature.

24. The lighting system of claim 23 where:

the multi-frequency generator generates the plurality of frequencies in a selected sequence of frequencies, each frequency being generated for the time duration corresponding to the frequency;

where the conditioning units include a filter capacitor connected to charge when the resonant frequency corresponding to the conditioning unit and corresponding to the receiving coil is generated by the multi-frequency generator and to couple the charge to the corresponding lights at an intensity level relative to the time duration of the resonant frequency; and where the control signal includes a sequence of voltage levels corresponding to the sequence of frequencies, each voltage level having the desired time duration.

25. The lighting system of claim 15 where the transmitting coil is adapted to be positioned on one side of a wall and the plurality of receiving coils are adapted to be positioned on an opposite side of the wall such that the transmitting coil and the receiving coils are inductively coupled across the wall.

26. The lighting system of claim 25 where the plurality of lights include at least three lights, the at least three lights adapted to respectively radiate light having a red color, a green color, and a blue color.

27. The lighting system of claim 15 further comprising:

a transmitter module adapted to contain the transmitting coil, the transmitter module positioned on an inside of a boat hull; and a receiver module adapted to contain the receiving coils, the receiver module positioned on the outside of the boat hull substantially opposite the transmitter module to power the plurality of lights via inductive coupling without breaching the boat hull.

28. The lighting system of claim 15 where the transmitting coil is positioned on an inside of a boat hull and the receiving coil is positioned on an outside of the boat hull in sufficient proximity to the transmitting coil to power the plurality of lights via inductive coupling without breaching the boat hull.

29. A method for wirelessly powering a lighting assembly, the method comprising:

forming a plurality of resonant circuits with a transmitting coil, a receiving coil, and a plurality of conditioning units, individual ones of the plurality of conditioning units having a resonant capacitor, individual ones of the resonant circuits having a distinct resonant frequency, and individual ones of the conditioning units connected to a corresponding light;

coupling an oscillating signal having a selected one of a plurality of frequencies corresponding to the resonant frequencies of the plurality of resonant circuits to the transmitting coil;

inductively coupling the oscillating signal to the receiving coil;

receiving the oscillating signal at the one of the plurality of conditioning units corresponding to the resonant circuit having the resonant frequency matching the selected frequency; and coupling a charge to the lights corresponding to the one of the plurality of conditioning units.

30. The method of claim 29 where the step of receiving the oscillating signal at the one of the plurality of conditioning units further comprises:

detecting a frequency of the oscillating signal at each conditioning unit;

if the frequency of the oscillating signal matches the resonant frequency of the corresponding conditioning unit, enabling the step of coupling the charge for the corresponding conditioning unit; and if the frequency of the oscillating signal does not match the resonant frequency of the corresponding conditioning unit, disabling the step of coupling the charge for the corresponding conditioning unit.

31. The method of claim 29 further comprising:

coupling a control signal to a multi-frequency generator to select the frequency from the plurality of frequencies and to generate the oscillating signal at the selected frequency for a time duration indicated in the control signal, the control signal including a sequence of voltage levels, individual voltage levels corresponding to one of the plurality of frequencies; and where:

the step of receiving the oscillating signal includes charging a filter capacitor using a DC power signal for the time duration of the selected frequency.

32. The method of claim 31 where the lights connected to corresponding conditioning units radiate a light of a different color, the method further comprising:

adjusting the intensity of the light generated by the lights coupled to corresponding conditioning units by adjusting the amount of charge coupled to the light; and adjusting the color of the light generated by the lighting assembly by adjusting the time durations for each of the plurality of frequencies.

33. The method of claim 31 where the lights connected to corresponding conditioning units radiate a light of a different color temperature, the method further comprising:

adjusting the intensity of the light generated by the lights coupled to corresponding conditioning units by adjusting the amount of charge coupled to the light; and adjusting the color temperature of the light generated by the lighting assembly by adjusting the time durations for each of the plurality of frequencies.

34. A method for wirelessly powering a lighting assembly, the method comprising:

forming a plurality of resonant circuits with a transmitting coil, a plurality of receiving coils, and a plurality of conditioning units, individual ones of the plurality of conditioning units having a resonant capacitor and connected to a corresponding one of the receiving coils, individual ones of the resonant circuits having a distinct resonant frequency, and individual ones of the conditioning units connected to a corresponding light, coupling an oscillating signal having a selected one of a plurality of frequencies corresponding to the resonant frequencies of the plurality of resonant circuits to the transmitting coil;

inductively coupling the oscillating signal to the plurality of receiving coils;

receiving the oscillating signal at the one of the plurality of conditioning units corresponding to the resonant circuit having the resonant frequency matching the selected frequency; and coupling a charge to the light corresponding to the one of the plurality of conditioning units.

35. The method of claim 34 where the step of receiving the oscillating signal at the one of the plurality of conditioning units further comprises:

detecting a frequency of the oscillating signal at each conditioning unit;

if the frequency of the oscillating signal matches the resonant frequency of the corresponding conditioning unit, enabling the step of coupling the charge for the corresponding conditioning unit; and if the frequency of the oscillating signal does not match the resonant frequency of the corresponding conditioning unit, disabling the step of coupling the charge for the corresponding conditioning unit.

36. The method of claim 34 further comprising:

coupling a control signal to a multi-frequency generator to select the frequency from the plurality of frequencies and to generate the oscillating signal at the selected frequency for a time duration indicated in the control signal, the control signal including a sequence of voltage levels, individual voltage levels corresponding to one of the plurality of frequencies; and where:

the step of receiving the oscillating signal includes charging a filter capacitor using a DC power signal for the time duration of the selected frequency.

37. The method of claim 36 where the lights coupled to corresponding conditioning units radiate a light of a different color, the method further comprising:

adjusting the intensity of the light generated by the lights coupled to corresponding conditioning units by adjusting the amount of charge coupled to the light; and adjusting the color of the light generated by the lighting assembly by adjusting the time durations for each of the plurality of frequencies.

38. The method of claim 36 where the lights connected to corresponding conditioning units radiate a light of a different color temperature, the method further comprising:

adjusting the intensity of the light generated by the lights coupled to corresponding conditioning units by adjusting the amount of charge coupled to the light; and adjusting the color temperature of the light generated by the lighting assembly by adjusting the time durations for each of the plurality of frequencies.

* * * * *